US006574347B1

(12) United States Patent
Linse

(10) Patent No.: US 6,574,347 B1
(45) Date of Patent: Jun. 3, 2003

(54) FLAT-PANEL LOUDSPEAKER WITH COMPRESSED DAMPENERS

(75) Inventor: Jason N. Linse, Portland, OR (US)

(73) Assignee: Logitech Europe S.A., Romanel-sur-Morges (CH)

( * ) Notice: Subject to any disclaimer, the term of this patent is extended or adjusted under 35 U.S.C. 154(b) by 0 days.

(21) Appl. No.: 09/716,183

(22) Filed: Nov. 17, 2000

(51) Int. Cl.[7] ..... H04R 25/00
(52) U.S. Cl. ..... 381/431; 381/152; 381/353
(58) Field of Search ..... 381/431, 423, 381/413, 398, 353, 354, 371, 373, 348, 430, 152; 181/166, 171, 172

(56) References Cited

U.S. PATENT DOCUMENTS 3,801,943 A * 4/1974 Bertagni
3,997,023 A * 12/1976 White
4,003,449 A * 1/1977 Bertagni
4,426,556 A * 1/1984 Saiki et al.
4,517,416 A * 5/1985 Goossens
4,803,733 A * 2/1989 Carver et al.
6,035,052 A * 3/2000 Fujihira et al.
6,282,298 B1 * 8/2001 Azima et al.
6,422,337 B1 * 7/2002 Tseng

* cited by examiner

*Primary Examiner*—Sinh Tran
(74) *Attorney, Agent, or Firm*—Ipsolon LLP

(57) ABSTRACT

An economical and compact flat panel loudspeaker is disclosed that effectively dampens undesirable standing waves that form in the diaphragm without adversely affecting the frequency response. The diaphragm is preferably anisotropic, and has at least one compliant compressed dampening member transposed between it and a substantially planar support. The dampening member is preferably positioned at or near at least one mode of constructive or destructive interference on the diaphragm, and urges the diaphragm away from the planar support, thereby placing as light bending force on the diaphragm, and a slight compression force on the dampening member. Accordingly, the dampening member serves as a sink for transferring undesirable standing waves from the diaphragm to the planar support. In a preferred embodiment, the dampening member is an elongated strip of compliant foam rigidly secured to the diaphragm and planar support and extending through a plurality of modes on the diaphragm. The loudspeaker can include a plurality of dampeners with each dampener having different compliance characteristics. Alternatively, one or more dampeners can have layers of different compliance.

13 Claims, 3 Drawing Sheets

FLAT-PANEL LOUDSPEAKER WITH COMPRESSED DAMPENERS

FIELD OF THE INVENTION

The present invention relates to loudspeakers and, in particular, to a flat-panel loudspeaker, preferably used as a compact speaker in a multimedia computer speaker system.

BACKGROUND AND SUMMARY OF THE INVENTION

The use of broadband loudspeaker systems with personal computers is gaining popularity. For example, high fidelity sound is desirable with many multimedia computer applications, such as presentations, games, DVD movies and the like. Moreover, as the applications for using a personal computer expand, the need for high fidelity sound with these applications will also increase.

The typical personal computer rests on a desk, and customers expect computer-related peripherals to be relatively inexpensive. Accordingly, it is desirable to make multimedia computer-related loudspeaker systems as compact and economical as possible, but without compromising sound quality.

Thin loudspeakers, commonly referred to as flat panel loudspeakers, have a small profile and can be manufactured inexpensively. One example of such a loudspeaker is found in published PCT patent application serial number WO 99/67974 to Lock et al. ("Lock et al.") and titled "Loudspeakers."

In general, the typical flat panel loudspeaker, such as that disclosed in Lock et al., includes at least one substantially planar diaphragm having different flex, or bending strength, characteristics in each of its major axes. The technical term for this characteristic is anisotropic. The diaphragm is secured to a substantially rigid frame defining a narrow chamber therein. A driver, usually centrally aligned with the diaphragm, is operably secured to the diaphragm within the chamber such that upon activation causes the diaphragm to vibrate at desired frequencies, thereby radiating sound therefrom.

In particular, the driver causes various desirable frequency wave patterns to originate in the center of the diaphragm and radiate outward toward the edges of the diaphragm. However, because of the interaction between the diaphragm and frame, upon reaching the substantially rigid frame supporting the diaphragm, many of the wave patterns are reflected back toward the driver along the diaphragm. The reflected waves interfere with the desirable waves emanating from the center of the diaphragm, forming a standing wave of constructive or destructive interference at particular frequencies along the diaphragm. Such interference compromises the quality of sound produced by the loudspeaker. For example, it can amplify the particular frequencies being subjected to the constructive interference by as much as 30 decibels above the other frequency sounds being emitted by the loudspeaker, distorting the overall sound quality of the loudspeaker. This characteristic is especially pronounced when the particular frequencies being subjected to constructive interference are high frequency sounds.

Efforts to reduce undesirable standing waves in flat panel loudspeakers have had limited success. For example, Lock et al. teaches that a dampening cloth may be secured adjacent to the edges to the diaphragm where it contacts the frame. Such a dampener reduces the likelihood of wave patterns from the diaphragm adversely conducting to the frame. However, such materials and their orientation do little to dampen the reflection of high frequency energy back along the diaphragm. Moreover, traditional devices for dampening limited frequency wave patterns, such as using devices to restrict a particular frequency movement of the diaphragm, tend to adversely limit the movement of the diaphragm for both desirable frequency wave patterns within that range and the undesirable reflected wave patterns of the same frequency. Accordingly, such devices adversely compromise the quality of sound generated by the loudspeaker.

The present invention overcomes these and other problems with known flat panel loudspeakers. It is an economical flat panel loudspeaker that has a small profile, but also effectively dampens undesirable standing waves that form in the diaphragm without adversely dampening the frequency response of the diaphragm, thereby providing superior sound quality.

In a preferred embodiment, a substantially planar anisotropic diaphragm and a substantially parallel, spaced-apart planar support are secured to a substantially rigid frame defining a narrow chamber therein. A driver is preferably centrally aligned with the diaphragm and is operably secured between the diaphragm and planar support within the chamber such that activation of the driver causes the diaphragm to vibrate at desired frequencies. At least one compliant dampening member is transposed between the diaphragm and planar support, preferably at or near at least one mode of constructive or destructive interference. The dampening member urges the diaphragm away from the planar support, thereby placing a slight bending force on the diaphragm, and a slight compression force on the dampening member. Accordingly, the dampening member serves as a sink for transferring undesirable standing waves from the diaphragm to the planar support.

More preferably, the dampening member is an elongated strip of compliant foam rigidly secured to the diaphragm and planar support and extending through a plurality of modes of constructive or destructive interference on the diaphragm. In one preferred embodiment, the diaphragm is generally rectangular shaped, and there are a plurality of dampening members forming at least three elongated strips of compliant foam. A first strip of foam is positioned between the driver and the upper edge of the diaphragm, and aligned substantially parallel to the upper edge of the diaphragm. A second strip of foam is positioned between the driver and one of the side edges of the diaphragm and aligned substantially perpendicular to the first strip, and a third strip of foam is positioned between the driver and the opposite side edge of the diaphragm and aligned substantially parallel to the second strip.

In a first alternative preferred embodiment, the first strip has a different compliance than the second and third strips. In a second alternative preferred embodiment, each dampening member has portions of different compliance aligned such that the less compliant (i.e., stiffer) portion is aligned adjacent to the planar support, and the more compliant portion is aligned adjacent to the diaphragm.

Additional objects and advantages of the present invention will be apparent from the detailed description of the preferred embodiment thereof, which proceeds with reference to the accompanying drawings.

DETAILED DESCRIPTION OF PREFERRED EMBODIMENTS

Figure 1:
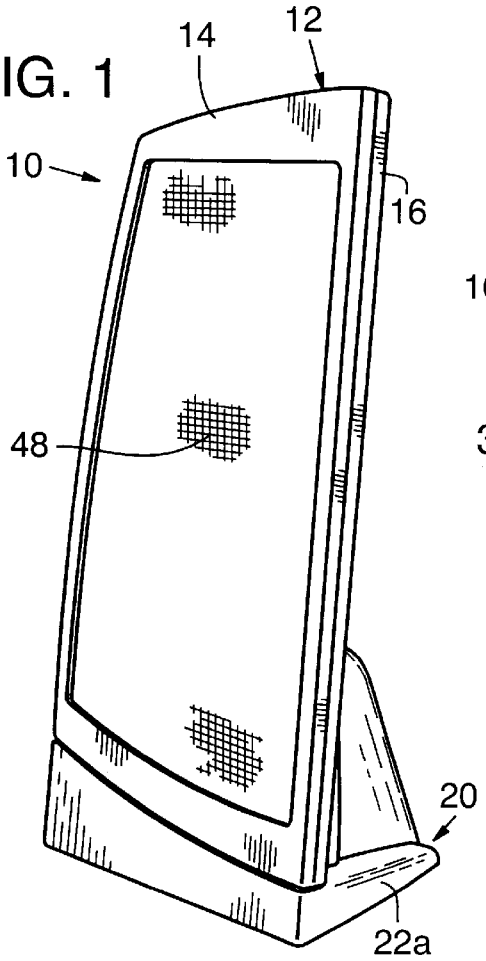
FIG. 1 is an isometric front view of a flat panel speaker in accordance with a first preferred embodiment of the present invention.

An economical and compact flat panel loudspeaker 10 having superior sound quality is shown in FIGS. 1–8.

Referring specifically to FIGS. 1–4, and 7–8, the loudspeaker 10 includes a conventional housing 12, preferably molded of plastic, having a front portion 14 secured to a rear portion 16 and supported by a base 20. More preferably, the base 20 is detachably secured to the housing 12 and includes either a stand (22*a*, FIG. 4) for allowing the housing 12 to rest on a substantially horizontal flat surface such as a desktop, a wall mounting bracket (22*b*, FIG. 8) for allowing the housing 12 to be detachably secured to a wall 24 or other substantially vertical surface, or a computer monitor mounting bracket (22*c*, FIG. 7) for detachably securing the housing 12 to a computer monitor 26 or other substantially cube-shaped object as shown.

Figure 3:
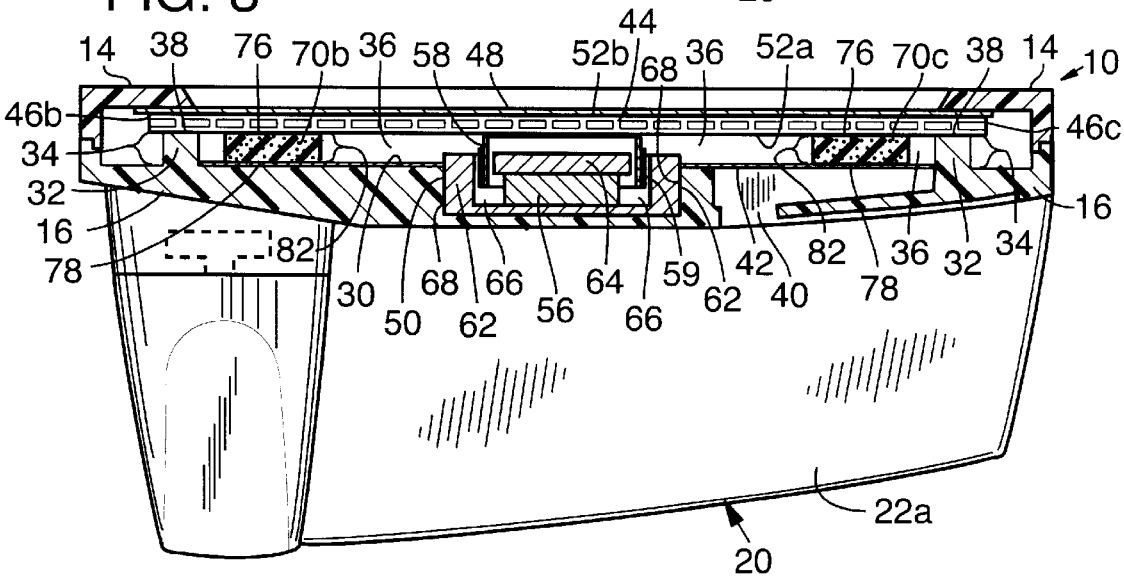
FIG. 3 is a cross-sectional view of the flat panel speaker of FIG. 1, taken along line 3—3 of FIG. 2.
Figure 4:
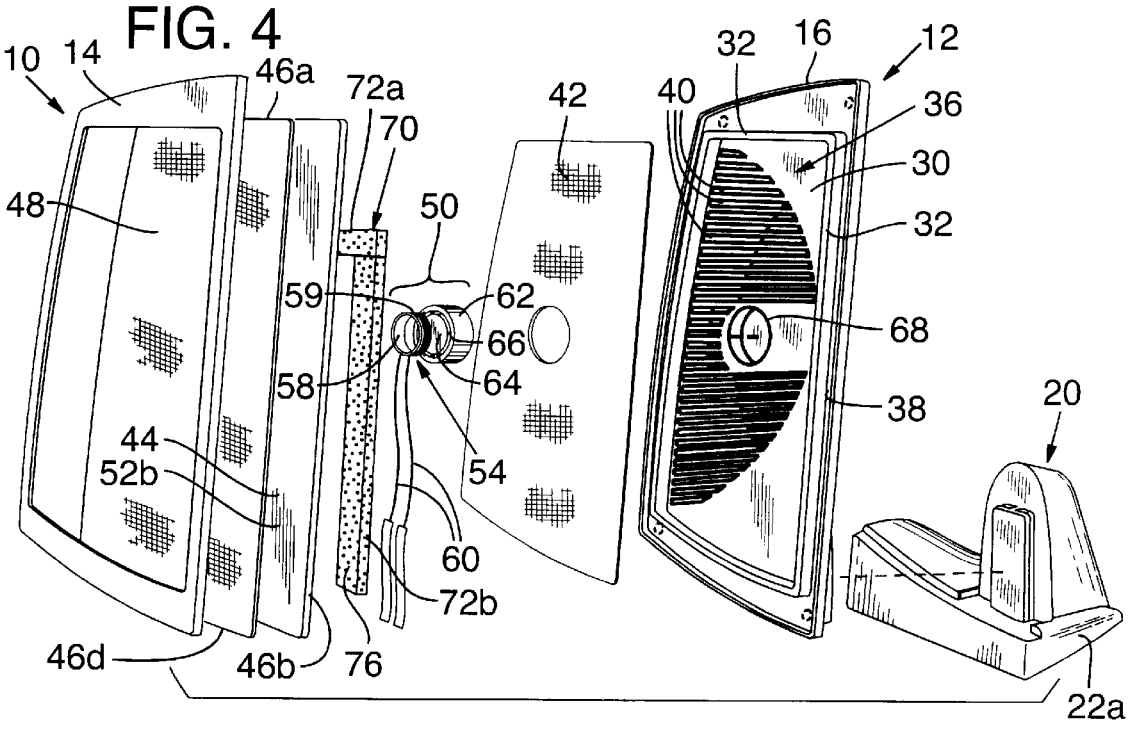
FIG. 4 is an exploded isometric view of the flat panel speaker of FIG. 1, showing a first detachable mounting base in accordance with a preferred embodiment of the present invention.

As best shown in FIGS. 3 and 4, the housing 12 includes a substantially planar support 30 encircled by a raised lip 32 having a substantially uniform height 34, thereby defining a chamber 36 therein. Preferably, the lip 32 has a substantially planar outer surface 38 aligned substantially parallel with the planar support 30.

The substantially planar support 30 preferably includes openings 40, which serve as conventional vents, placing the chamber 36 in pneumatic communication with the outside environment. More preferably, these openings 40 are covered by a thin layer, or sheet, of a gas permeable material, such as a screen 42. Such material serves to prevent inadvertent material from entering the chamber 36, thereby protecting the internal components of the loudspeaker 10. Moreover, the mesh of the screen 42 can be sized to restrict the flow rate of air passing through the openings 40, thereby allowing the loudspeaker 10 to be properly fine tuned.

A substantially planar diaphragm 44 extends over the chamber 36 and is secured to the lip 32 of the housing 12 at the outer edge 46*a*–*d* of the diaphragm 44, preferably with adhesive (not shown), thereby aligning the substantially planar diaphragm 44 so that it is spaced apart from, and generally parallel to, the substantially planar support 30. Preferably, a screen 48 or cover extends over the diaphragm 44 to protect it and make it appear more aesthetically pleasing.

The diaphragm 44 is preferably made with an anisotropic material, with a bending strength in a first direction of the plane of the material being greater than the bending strength along a line along the plane of the material and substantially perpendicular to the first direction. More preferably, the diaphragm 44 is an elongated structure with a longitudinal bending strength being about twice its transverse bending strength. Even more preferably, the material is constructed of a polypropylene copolymer, fluted, has a tensile strength of about 28 MPs or more, a shore hardness of 67 or more, is approximately 3 millimeters thick and has a mass of approximately 500 grams per square meter or less. One known material having these properties is a sheet of corrugated polypropylene copolymer, which is commonly known as "core flute" material, because of its internal longitudinal "flutes" 49 or corrugations. Alternatively, the material can compromise a laminate having a core formed of ribs, tubes, corrugations, or the like.

A driver 50 is positioned adjacent to the inner surface 52*a* of the diaphragm 44, and preferably centrally aligned with the center of the diaphragm 44 as best shown in FIG. 4. Preferably, the driver 50 includes a voice coil 54 rigidly secured to one of the diaphragm 44 or substantially planar support 30 with the other of the diaphragm 44 or substantially planar support 30 receiving a magnet 56 aligned with the voice coil as shown in FIG. 4. In FIG. 4 the voice coil 54 is secured to the diaphragm 44 and the magnet 56 is secured to the substantially planar support 30. However, the reverse orientation will operate equally effectively.

Preferably, the voice coil 54 has a conventional wire winding 59 secured around a former 58. The winding 59 is connected by leads 60 to terminals (not shown) on the loudspeaker 10, or an extension wire (not shown) leading to a conventional loudspeaker power and control system (not shown). Preferably, the magnet 56 is constructed with neodymium and secured at one end to a cylindrical portion 62, which is preferably steel. A preferably steel top plate 64 is secured to the opposite end of magnet 56 defining a gap 66 between the cylindrical portion 62 and the magnet 56 and top plate 64 as best shown in FIG. 3. One end of the cylindrical portion 62 is rigidly secured within a recess 68 in the substantially planar support 30. The opposite end of the cylindrical portion 62 is spaced apart, but encircles a portion of the voice coil 54. In particular, the magnet 56 and top plate 64 are spaced apart from the cylindrical portion 62, but received within the cylindrical portion 62, such that a portion of the winding 59 and former 58 of the voice coil 54 moves within the gap 66 without contacting the cylindrical portion 62, the magnet 56, or the top plate 64.

The driver 50 operates by varying the electric current leading to it, causing the voice coil 54 to move with respect to the magnet 56, and thereby moving the diaphragm 44 at desired frequencies for producing sound. In particular, the driver 50 causes various desirable frequency wave patterns to originate in the center of the diaphragm 44 and radiate outward toward the outer edge 46*a*–*d* of the diaphragm 44. However, upon interacting with the substantially rigid lip 32 of the housing 12, many of the wave patterns are reflected back toward the driver 50 along the diaphragm 44. Some of the reflected waves interfere with the desirable waves emanating from the center of the diaphragm 44, forming acoustically undesirable modes of constructive or destructive interference 69 (referred to collectively as "modes of interference" herein), at particular locations along the diaphragm 44. The particular frequencies and locations of these undesirable modes of interference 69 are related to the size and shape of the diaphragm 44 and chamber 36, and the type of materials used in constructing the various components of the loudspeaker 10. However, for a given set of loudspeaker design parameters, the particular frequencies and locations of the modes of interference, which are also commonly known as undesirable standing waves, are identifiable and generally fixed.

One known method for determining the location of the modes of interference 69 is to remove the protective screen 48 from over the diaphragm 44 and position the loudspeaker 10 such that diaphragm's 44 outer surface 52*b* is substantially horizontal. A powder, or other granulated material is spread evenly over the outer surface 52*b* of the diaphragm 44, and the loudspeaker 10 is activated. Areas of peak constructive interference will tend to push the powder away from those areas, thereby identifying the modes of constructive or destructive interference 69 of operation for that particular design.

These undesirable standing waves adversely affect the sound quality of the loudspeaker 10. However, they can be eliminated without adversely affecting the desirable movements of the diaphragm 44, by extending a compressed dampener 70 between the diaphragm 44 and planar support 30 at or near each of the modes of interference 69. In particular, the compressed dampener 70 urges the diaphragm 44 away from the planar support 30, thereby placing a slight bending force on the diaphragm 44, and a slight compression force on the dampener 70. Accordingly, the dampener 70 serves as a sink for transferring undesirable standing waves from the diaphragm 44 to the planar support 30.

Preferably, the dampener 70 is a compliant material that is displaced in direct proportion to the force applied to it, and it is compressed between the diaphragm 44 and planar support 30. Materials having such properties include common open or closed cell foam. One such foam that appears to work particularly well in this application is low density polyvinyl chloride ("PVC") foam. One such known foam is sold in tape form by Scapa Tapes North America of Windsor, Conn., USA under the brand name P3097. This foam has a typical density of 7 lb./ft.$^3$ (115 Kg/m$^3$), a typical Shore Hardness of 20 (OO scale), and a compression deflection of 0.8 N/cm$^2$. It typically requires a force of 1.7 N/cm$^2$ to compress it by 30%, and a force of 2.43 lb./in.$^2$ (0.17 Kg/cm$^2$) to compress it by 50%. Other foams or compliant materials having different specific physical properties will also work in this application.

Figure 2:
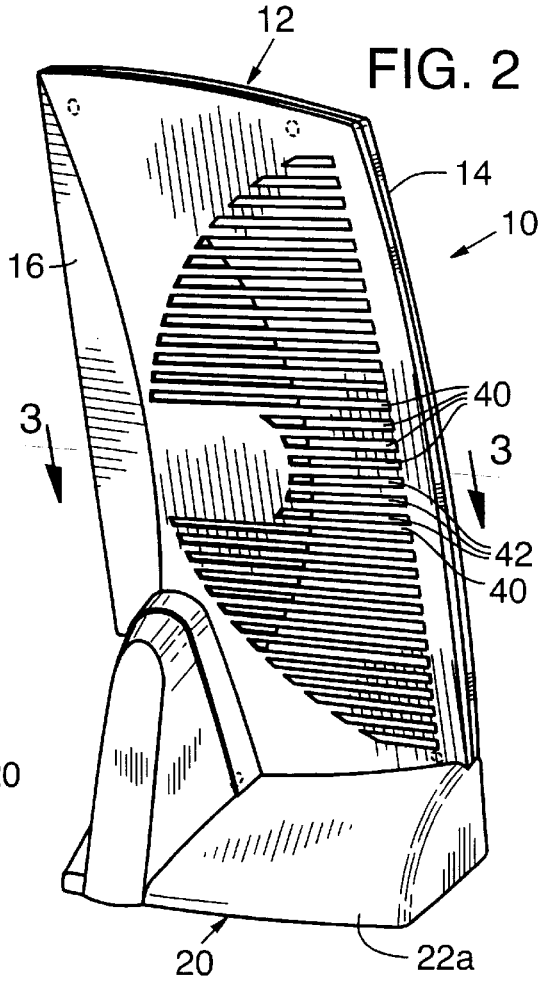
FIG. 2 is an isometric back view of the flat panel speaker of FIG. 1.
Figure 5:
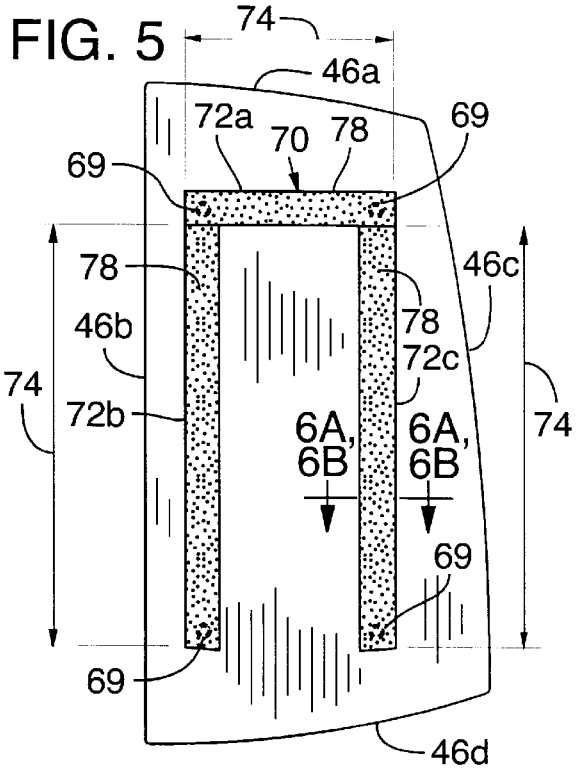
FIG. 5 is a back view of a diaphragm the flat panel speaker of FIG. 1 showing a possible orientation of a compressed dampener in accordance with a preferred embodiment of the present invention.
Figure 6A:
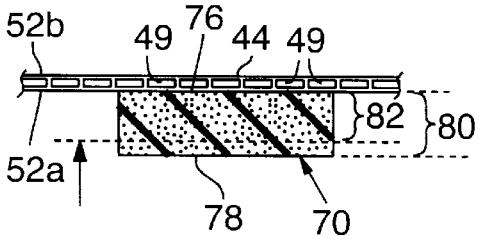
FIG. 6A is a fragmentary cross-sectional view of an uncompressed monolithic dampener taken along line 6A—6A of FIG. 5 in accordance with a preferred embodiment of the present invention.

Preferably, the dampener 70 includes one or more strips 72*a*, 72*b*, 72*c* (shown in FIG. 5) of compliant foam, each strip 72*a*, 72*b*, 72*c* having a length 74, a first surface 76, an opposite second surface 78, and a thickness 80 (FIG. 6A). More preferably, the strips 72*a*, 72*b*, 72*c* are rigidly secured to the diaphragm 44 and planar support 30 along their respective first and second surfaces 76, 78 respectively. As best shown in FIG. 6A, the thickness 80 of the dampener is slightly larger than the distance 82 between the diaphragm 44 and planar support member 30 such that the dampener 70 is slightly compressed when the loudspeaker 10 is assembled. Each strip 72*a*, 72*b*, 72*c*, is aligned along the inner surface 52*a* of the diaphragm 44 such that each strip is over or near a plurality of modes of interference 69 as shown in FIG. 5. Moreover, the dimensions of the foam and its density are selected to optimize the absorption of the undesirable standing waves from the diaphragm to the planar support.

Where the desired shape of the loudspeaker 10 is substantially rectangular as shown in FIGS. 1 and 2, the diaphragm 44 is generally rectangular shaped, and there are at least three elongated strips 72*a*, 72*b*, 72*c* of compliant foam, all of which are preferably monolithic as shown in FIG. 6A and have the same compliance characteristics. A first strip 72*a* of foam is positioned between the driver 50 and the upper edge 46*a* of the diaphragm 44, and aligned substantially parallel to the upper edge 46*a* of the diaphragm 44. A second strip 72*b* of foam is positioned between the driver 50 and one of the side edges 46*b* of the diaphragm 44 and aligned substantially perpendicular to the first strip 72*a*, and a third strip 72*c* of foam is positioned between the driver 50 and the opposite side edge 46*c* of the diaphragm 44 and aligned substantially parallel to the second strip 72*b*.

Figure 6B:
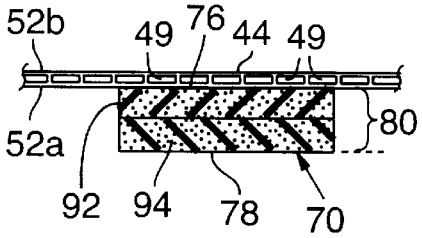
FIG. 6B is a fragmentary cross-sectional view of an uncompressed dual-density dampener taken along line 6B—6B of FIG. 5 in accordance with an alternative preferred.embodiment of the present invention.
Figure 7:
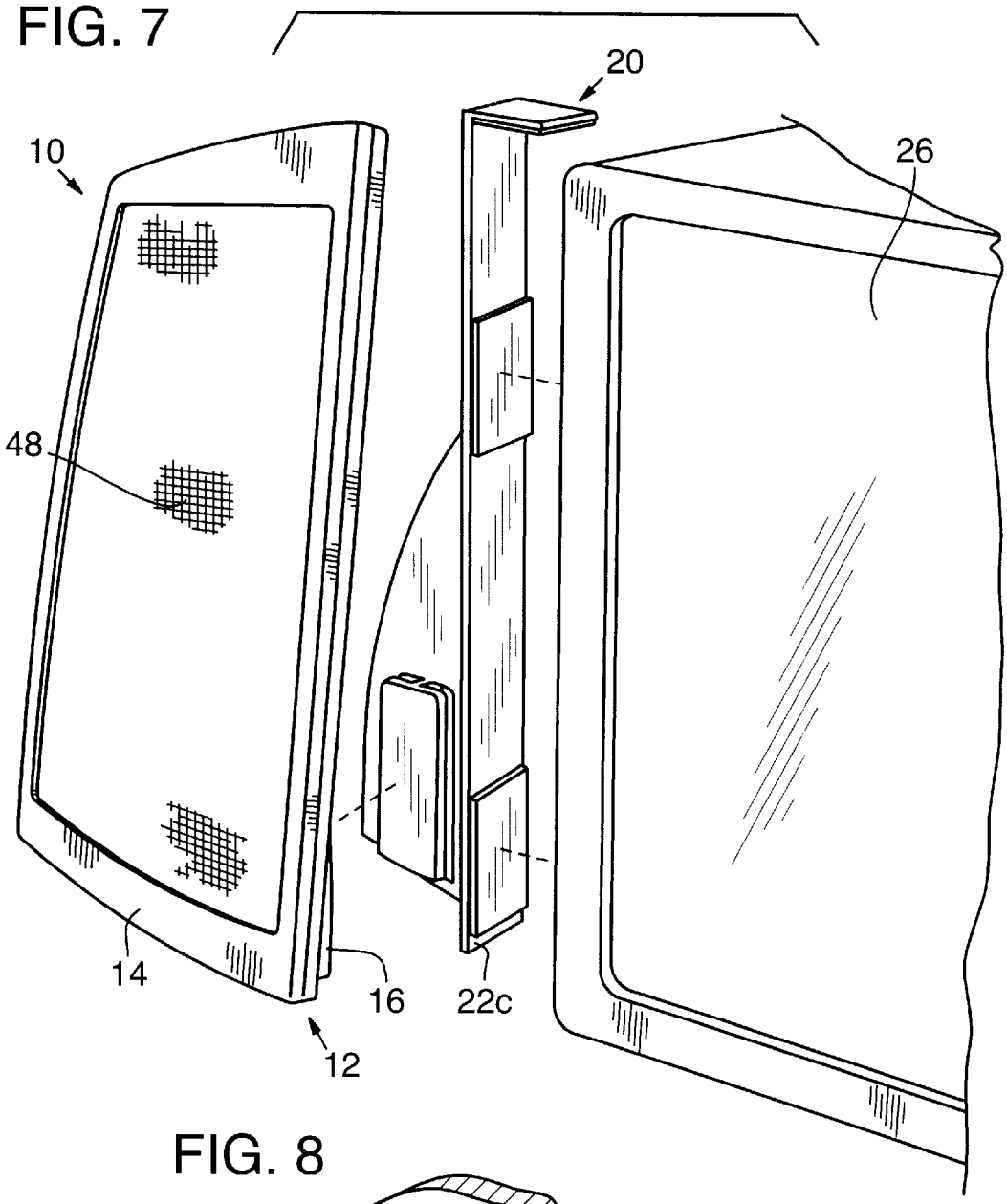
FIG. 7 is an isometric view of the flat panel speaker in accordance with FIG. 1 showing a second detachable mounting base in accordance with a preferred embodiment of the present invention.
Figure 8:
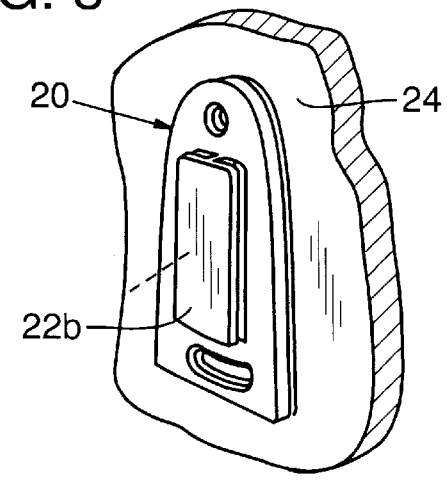
FIG. 8 is an isometric view of a third detachable mounting base in accordance with a preferred embodiment of the present invention.

In a first alternative preferred embodiment, the first strip 72*a* is more compliant than the second and third strips 72*b*, 72*c*, respectively. In a second alternative preferred embodiment, each strip 72*a*, 72*b*, and 72*c* has portions of different compliance preferably aligned such that the less compliant (i.e., stiffer) portion 92 is aligned adjacent to the planar support 30, and the more compliant portion 94 is aligned adjacent to the diaphragm 44 as shown in FIG. 6B.

Having described and illustrated the principles of our invention with reference to a preferred embodiment thereof, it will be apparent that the invention can be modified in arrangement and detail without departing from such principles. For example, the loudspeaker 10 or its diaphragm 44 can assume any desirable shape, such as circular, oval, oblong, or the like. With each shape, the frequency and location of its modes of interference 69 can be determined, and an appropriately sized dampener 70 having appropriately determined compliance characteristics can be selected and positioned at or near one or more modes of operation. Similarly, the particular location of the modes of interference 69 shown in FIG. 5 are for illustrative purposes only, and should not be viewed as limiting the scope of the claimed invention.

Moreover, the chamber 36 could be pneumatically sealed from the outside environment, or alternatively, venting could be provided through any side or sides of the loudspeaker, including the front of the loudspeaker. Also, the housing 12 can be constructed of any suitable material, including conventional fiberboard or wood. In addition, more than one driver 50 may be operably secured within the chamber, and the substantially planar support could be a second, or alternative, diaphragm.

In view of the many possible embodiments to which the principles may be put, it should be recognized that the detailed embodiment is illustrative only and should not be taken as limiting the scope of our invention. Accordingly, we claim as our invention all such modifications as may come within the scope and spirit of the following claims and equivalents thereto.

I claim:

1. A flat-panel loudspeaker including:

a housing having an acoustic chamber and a support adjacent to said acoustic chamber;

a substantially planar diaphragm secured to the housing and extending over the chamber defining a gap between said diaphragm and said support;

a driver operably secured between said diaphragm and said support;

a compliant dampener having layers of different compliance secured within said gap and extending between said diaphragm and said support; and, wherein said support includes openings for placing said chamber in pneumatic and acoustic communication with an outside environment.

2. A flat-panel loudspeaker including:

a housing having an acoustic chamber and a support adjacent to said acoustic chamber, said support having openings for placing said acoustic chamber in pneumatic and acoustic communication with an outside environment and a screen extending over said openings;

a substantially planar diaphragm secured to the housing and extending over the chamber defining a gap between said diaphragm and said support;

a driver operably secured between said diaphragm and said support; and, a compliant dampener secured within said gap and extending between said diaphragm and said support.

3. The flat-panel loudspeaker of claim 2, wherein said support is substantially planar, and said diaphragm is spaced apart and aligned substantially parallel to said support.

4. The flat-panel loudspeaker of claim 2, wherein said compliant dampener is an elongated strip of material.

5. The flat-panel loudspeaker of claim 4, wherein said strip of material is substantially rectangular and has a thickness greater than said gap such that said material is compressed between said diaphragm and said support.

6. The flat-panel loudspeaker of claim 5, wherein said strip of material is foam.

7. The flat-panel loudspeaker of claim 6, wherein said foam is open cell foam.

8. The flat-panel loudspeaker of claim 6, wherein said foam is closed cell foam.

9. The flat-panel loudspeaker of claim 2, wherein said support is substantially rigid.

10. The flat-panel loudspeaker of claim 2, wherein said support is a substantially planar.

11. The flat-panel loudspeaker of claim 2, wherein said dampener is a monolithic structure having a uniform compliance.

12. A flat-panel loudspeaker including:

a substantially rectangular shaped housing having an acoustic chamber and a support adjacent to said acoustic chamber;

a substantially planar diaphragm secured to the housing and extending over the chamber defining a gap between said diaphragm and said support.said diaphragm being in pneumatic and acoustic communication with said chamber and having a plurality of modes of interference during operation of the loudspeaker;

said diaphragm is substantially rectangular shaped defining an upper edge, a lower edge, and two sides;

a driver operably secured adjacent to a center of said diaphragm and between said diaphragm and said support; and, a plurality of compliant dampeners defining a first, second, and third elongated dampeners, said plurality of compliant dampeners extending between said diaphragm and said support;

said first dampener positioned between said driver and said upper edge of said diaphragm and aligned substantially parallel to said upper edge of said diaphragm such that it extends over at least two of said plurality of modes of interference;

said second dampener positioned between said driver and one of said sides of said diaphragm substantially perpendicular to said first dampener such that it extends over at least two of said plurality of modes of interference; and said third dampener position between said driver and the other of said sides of said diaphragm substantially parallel to said second dampener such that it extends over at least two of said plurality of modes of interference.

13. The flat-panel loudspeaker of claim 12, wherein said first dampener has a different compliance than said second and third dampeners.

* * * * *